US005887700A

United States Patent [19]

Priuli

[11] Patent Number: 5,887,700

[45] Date of Patent: Mar. 30, 1999

[54] DEVICE FOR SELECTIVE STORAGE OF BARS FOR METAL BAR CROPPING LINES

[75] Inventor: Dante Bruno Priuli, Darfo, Italy

[73] Assignee: Schnell S.p.A., Fano, Italy

[21] Appl. No.: 865,159

[22] Filed: May 29, 1997

[30] Foreign Application Priority Data

Jun. 7, 1996 [IT] Italy ..... B096A0307

[51] Int. Cl.[6] ..... B65G 47/30

[52] U.S. Cl. ..... 198/418.6; 198/431

[58] Field of Search ..... 198/347.4, 418.5, 198/418.6, 426, 431, 597, 803.14

[56] References Cited

U.S. PATENT DOCUMENTS

| | | | |
|---|---|---|---|
| 3,370,494 | 2/1968 | Schenck . | |
| 3,411,614 | 11/1968 | Schell | 198/597 X |
| 3,648,553 | 3/1972 | Eckhard et al. . | |
| 3,894,631 | 7/1975 | Rose et al. | 198/418.6 X |
| 4,262,793 | 4/1981 | Hebenstreit et al. | 198/431 X |
| 4,863,008 | 9/1989 | Doi | 198/418.6 X |

FOREIGN PATENT DOCUMENTS

| | | |
|---|---|---|
| 2 675 065 | 10/1992 | France . |
| 1 604 957 | 12/1981 | United Kingdom . |

*Primary Examiner*—James R. Bidwell
*Attorney, Agent, or Firm*—Guido Modiano; Albert Josif

[57] ABSTRACT

A storage device for metal bar cropping lines, comprising: elements for forming a plurality of compartments parallel to each other and arranged side-by-side for storing cropped metal bars, said compartments being arranged longitudinally with respect to a cropping line; elements for conveying said cropped metal bars, fed by said cropping line, selectively to said storage compartments; and flexible elements for shifting said storage compartments transversely to said cropping line between a position for receiving said cropped metal bars and a position for unloading said cropped metal bars.

20 Claims, 13 Drawing Sheets

DEVICE FOR SELECTIVE STORAGE OF BARS FOR METAL BAR CROPPING LINES

BACKGROUND OF THE INVENTION

The present invention relates to a storage device which can be optimized for metal bar cropping lines.

It is known that lines for cropping metal bars meant to constitute the reinforcement frames of reinforced-concrete structures and the like are used in the field of building. These so-called "fixed" cropping lines generally have means for feeding the metal bars to a cropping station provided with locator means adapted to adjust the length of the portions cropped from the bars; the feeder means take the bars to be cropped from a corresponding magazine and push them into abutment against the locator means, along a measuring unit generally provided with roller supporting means. Adapted cropping means then crop the bars to the preset size.

In other cases, no locator means are provided and the bars to be cropped are measured by means of wheels connected to encoder devices.

In performing the cropping operation, there is an economic requirement to minimize waste. In order to achieve this result, an electronic computer is normally used; according to the batches to be produced, the computer associates several sizes so as to approximate the total length of the bars to be cropped. The batches to be produced are in fact generally constituted by bars of different lengths according to the various intended uses.

It is thus known that it is necessary to arrange, to the side of the cropping line, storage devices adapted to separately collect the bars cropped according to the different sizes, so as to reconstitute the batches. In practice, the metal bars are cropped automatically into portions having different lengths, which correspond to the required sizes; these portions are then conveyed to respective storage areas. This step is usually defined "cropping optimization".

Simpler cropping lines usually have two storage areas, arranged respectively on either side of the line. The storage areas have respective fixed comb-shaped devices, often four on the left and four on the right, generally one whereof is adapted to receive the bars which will remain straight and the other one is adapted to receive the bars to be shaped, which are then conveyed to bending benches. Each one of the comb-shaped devices forms a plurality of stores meant to receive respective groups of bars cropped to the different intended sizes. Before being removed from the storage devices, the cropped bars are generally tied in bundles.

In order to move the cropped bars it is usually necessary to use a crane. This is a considerable drawback, especially as regards the bars to be conveyed to the bending benches.

In order to overcome this drawback, i.e., to avoid the use of cranes, it has been suggested to use a storage device constituted by a large truck movable along rails arranged transversely below the cropping line. The truck is adapted to receive the cropped bars and to sort them directly to the bending benches; for this purpose, the truck is provided with a plurality of roller conveyors, usually four, meant to receive the different batches of bars to be kept straight or to be shaped.

In addition to allowing a smaller number of stores and therefore reduced cropping optimization, this solution entails a higher cost. The fact is also objected that both the bars to be kept straight and the bars to be shaped are collected on the truck, and this is a cause of potential confusion. Moreover, the presence of a movable element is a risk factor with respect to the system safety.

Another solution which has been suggested in order to obviate the above-mentioned drawbacks consists in laterally sorting the bars to be shaped to a chain conveyor which directly feeds a bending bench arranged to the side of the cropping line. In practice, the cropped bars to be bent fall laterally onto the chains, which are actuated along planes lying transversely to the cropping line and provided with teeth which form appropriate compartments, the bars being then conveyed to the bending bench.

This solution allows to reduce the system bulk and to avoid the risks connected to moving parts, but it does not allow true cropping optimization. The device in fact has a single store which can be selected, i.e., which is available to divide the different batches of bars, and it is therefore impossible to separate the bars after cropping. Accordingly, the most important characteristic distinguishing cropping lines, i.e., optimization, is set aside.

SUMMARY OF THE INVENTION

A principal aim of the present invention is to solve the above-described problem by providing a storage device for cropping lines which is compact and allows to ensure correct optimization of the cropping of metal bars and, if necessary, to feed the benches for bending the bars automatically.

Within the scope of this aim, another object of the present invention is to provide a storage device which is simple in concept, safely reliable in operation, versatile in use, and has a relatively low cost.

This aim and this object are both achieved, according to the invention, by the present storage device for metal bar cropping lines, characterized in that it comprises: means for forming a plurality of compartments parallel to each other and arranged side-by-side for storing cropped metal bars, said compartments being arranged longitudinally with respect to a cropping line; means for conveying said cropped metal bars, which are fed by said cropping line, selectively to said storage compartments; and chain means for shifting said storage compartments transversely to said cropping line between a position for receiving said cropped metal bars and a position for unloading said metal bars.

BRIEF DESCRIPTION OF THE DRAWINGS

Further characteristics and advantages of the present invention will become apparent from the following detailed description of preferred embodiments of the storage device for metal bar cropping lines, illustrated only by way of non-limitative example in the accompanying drawings, wherein.

DESCRIPTION OF THE PREFERRED EMBODIMENTS

Figure 1A:
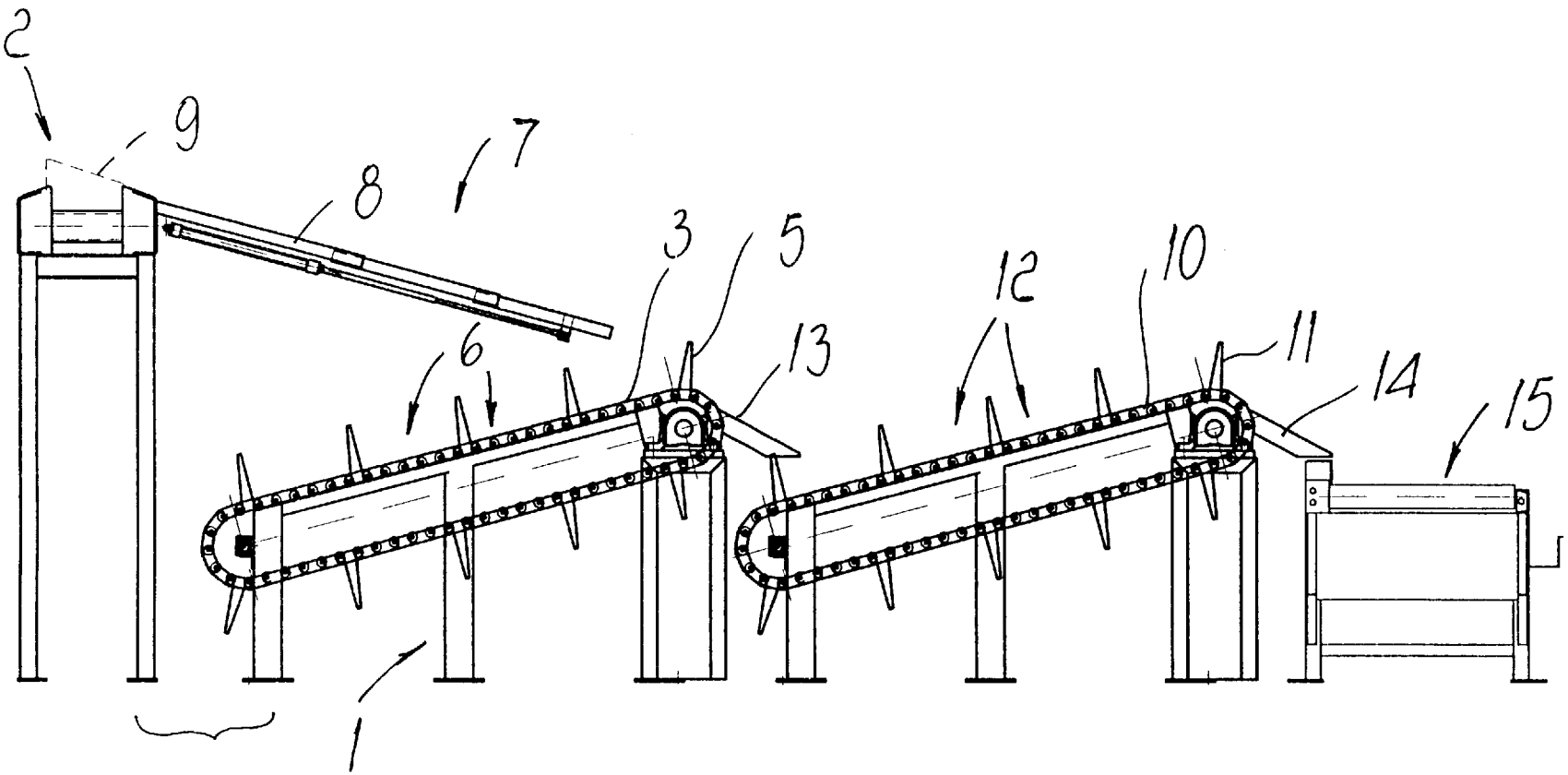
FIGS. 1*a*, 1*b* and 1*c* are respective schematic elevational views of the storage device according to the resent invention, in different operating configurations.

With particular reference to the above figures, the reference numeral 1 designates the fixed frame of the storage device, which lies longitudinally to the side of a conventional metal bar cropping line 2.

Figure 2A:
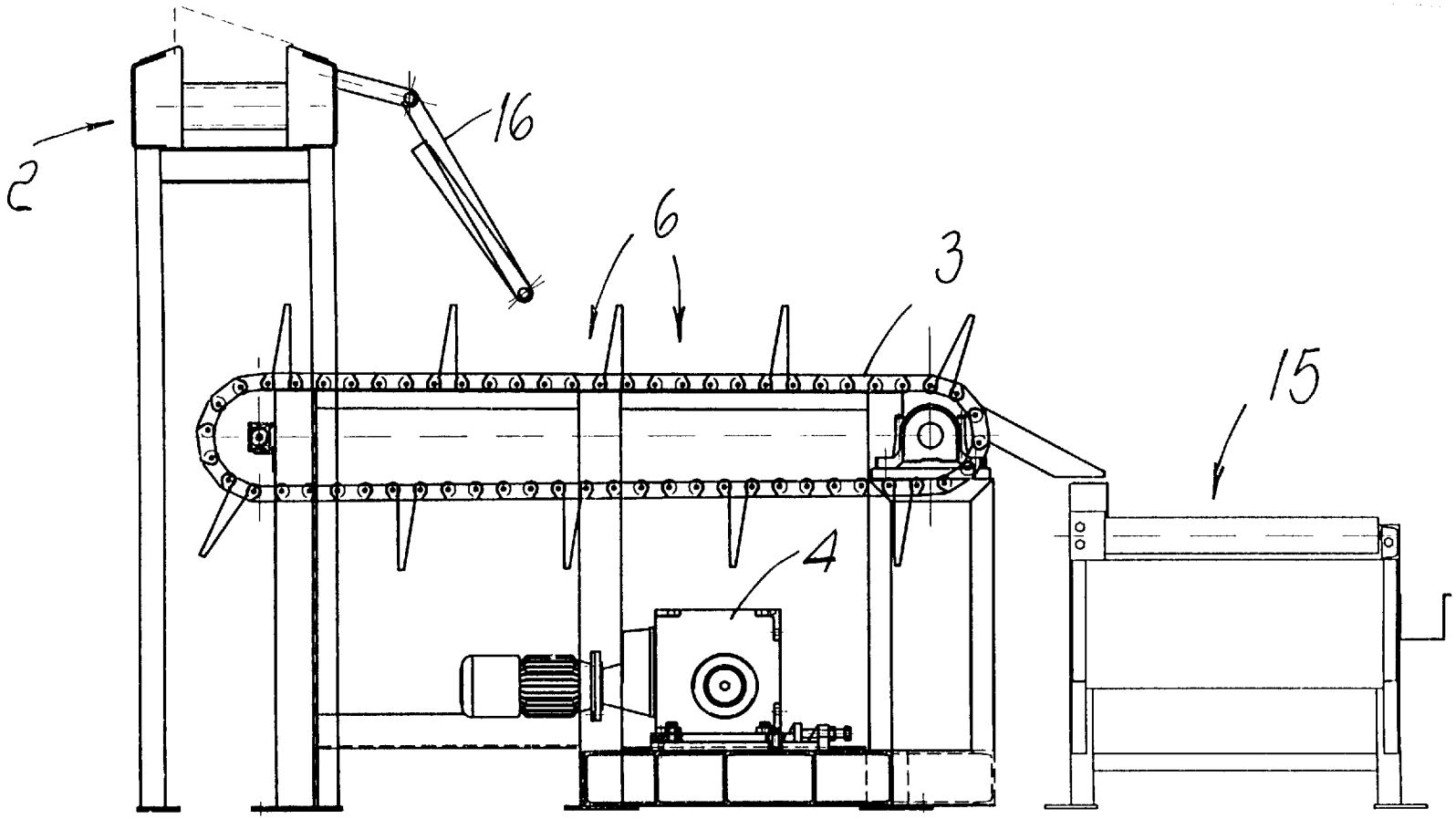
FIGS. 2*a*, 2*b* and 2*c* are corresponding elevational views of a second embodiment of the storage device according to the present invention.
Figure 2B:
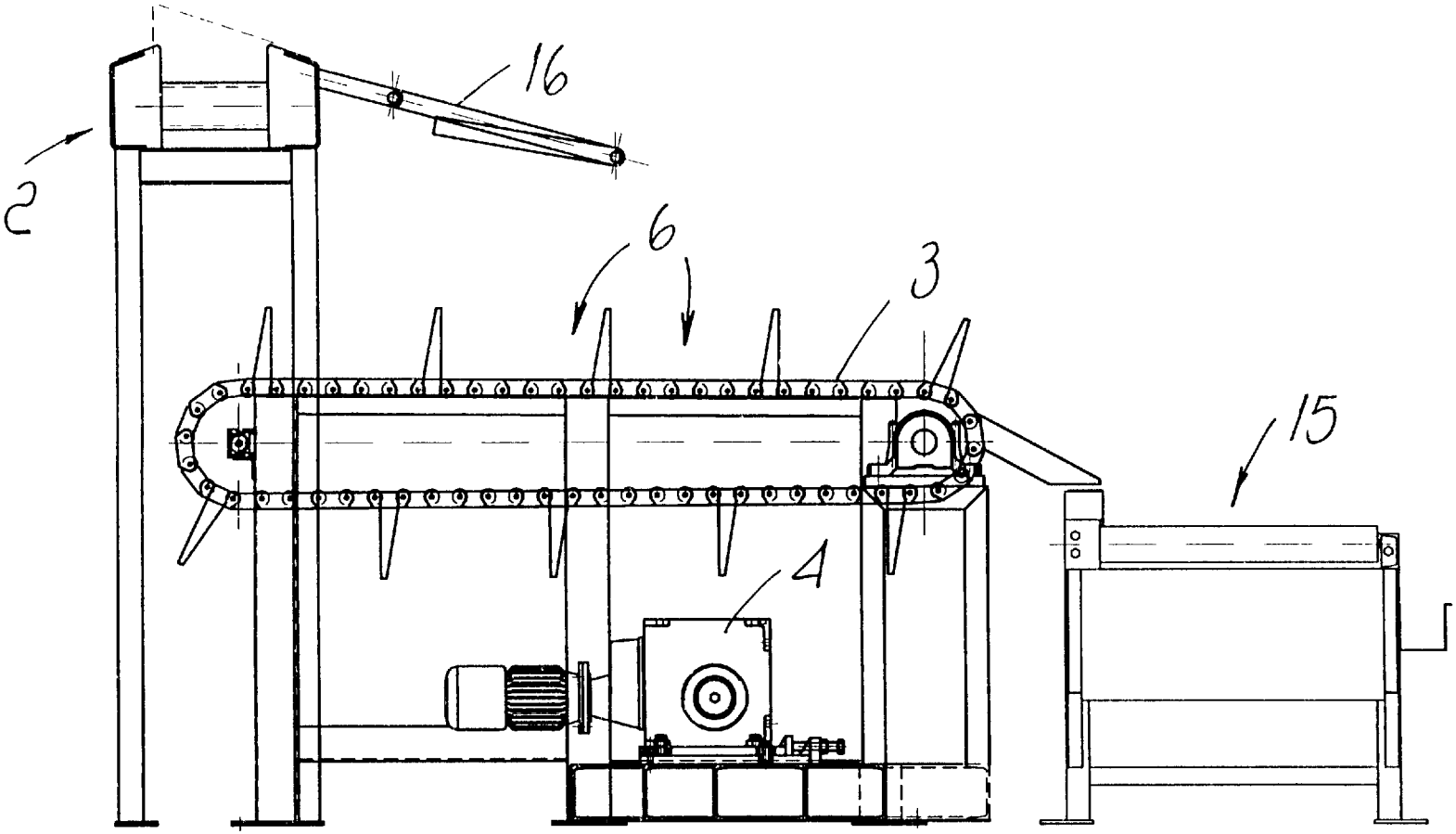
Figure 2C:
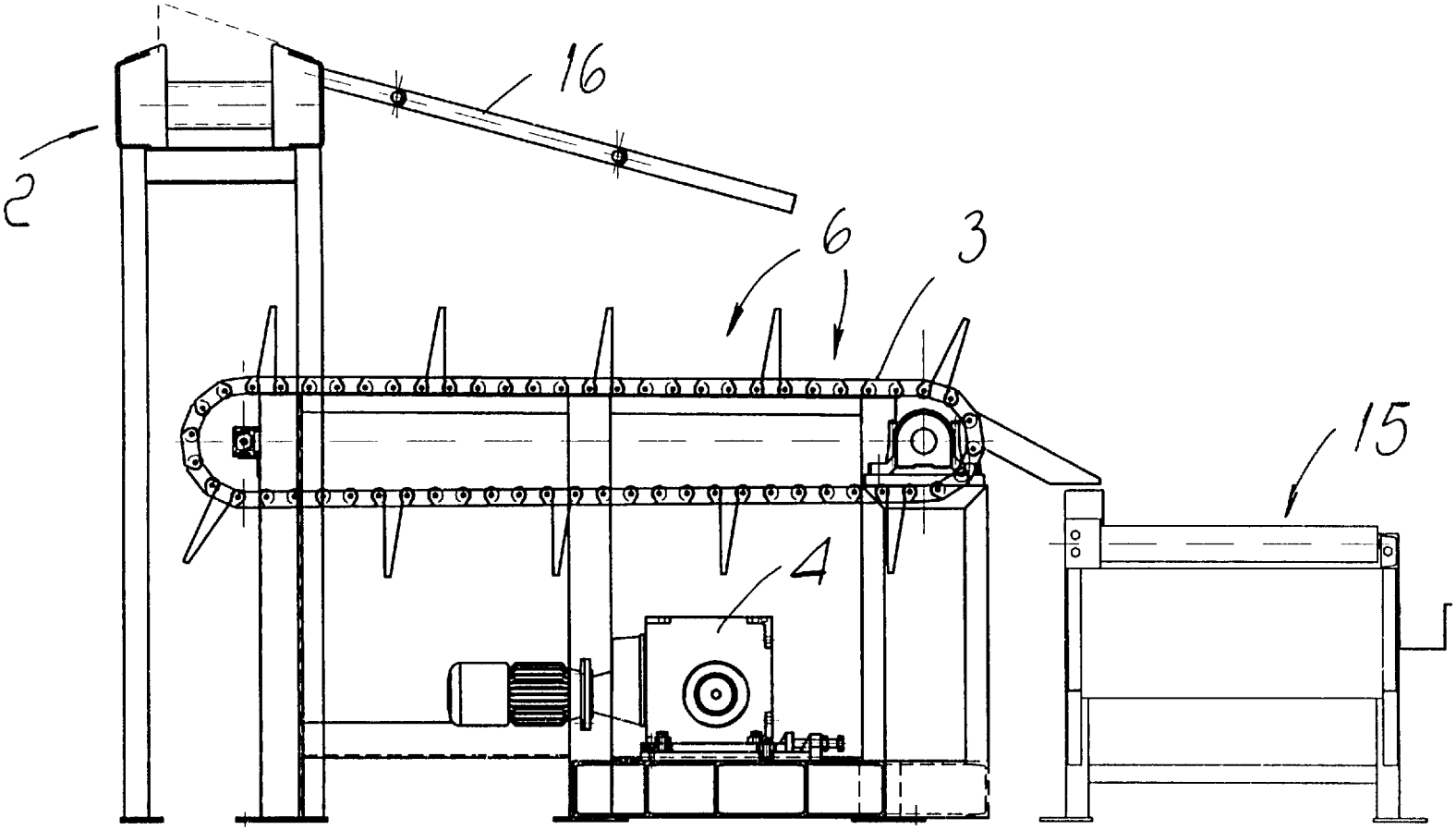

The storage device has flexible means, for example chain units 3, arranged respectively on a vertical plane which lies transversely to the cropping line 2 and can be actuated along an annular path by an adapted motor element illustrated in FIGS. 2*a*, 2*b* and 2*c*, where it is designated by the reference numeral 4. The chain units 3 support a plurality of partitions 5 adapted to form respective side-by-side cropped metal bar storage compartments 6 which are arranged parallel to each other and longitudinally with respect to the cropping line; the storage compartments 6 are meant to receive metal bars of different sizes, as specified hereinafter.

Conveyors 7 for the cropped metal bars are adapted to cooperate with the storage compartments 6 and are rigidly coupled laterally to the cropping line 2, so as to protrude above frame 1.

Conveyors 7 are constituted by a plurality of arms 8 protruding laterally from the top of the cropping line 2, on vertical planes which lie transversely to said cropping line 2, and appropriately inclined downwards. The conveyor arms 8 can extend telescopically, so as to assume different lengths in order to convey the cropped bars to the different storage compartments 6.

In order to transfer the cropped bars to the conveyor arms 8, the cropping line 2 has overturning extractors, as shown in the drawing by the dashed lines 9.

The chain units 3 are adapted to cooperate with further chain units 10 likewise arranged on vertical planes, transversely to the cropping line 2, and adapted to be actuated along an annular path. The chain units 10 support corresponding partitions 11 adapted to form respective compartments 12 for depositing the cropped metal bars, the compartments being arranged parallel to each other and longitudinally with respect to the cropping line.

Conveniently, the chain units 3 and 10 are inclined upwards on their respective vertical planes, starting from the side directed towards the cropping line 2, so as to reduce space requirement transversely to the cropping line.

Fixed chutes 13 are arranged between the chain units 3 and 10, are rigidly coupled to the frame 1, and facilitate the transfer of the cropped bars. Additional fixed chutes 14 are provided at the exit of the chain units 10 to facilitate unloading of the cropped bars onto a bending bench 15 lying longitudinally to the cropping line 2, beyond the storage device.

Operation of the storage device is easily understandable from the above description.

The cropped bars to be bent are removed from the cropping line 2 by actuating the overturning elements 9 and are pushed onto the arms 8 of the conveyors 7, which feed the storage compartments 6 formed by the partitions 5 of the chain units 3.

It should be noted that arms 8 form an inclined plane adapted to convey the metal bars towards the chain storage device. The extension of said inclined plane varies according to the length assumed by the telescopic arms 8.

Figure 1B:
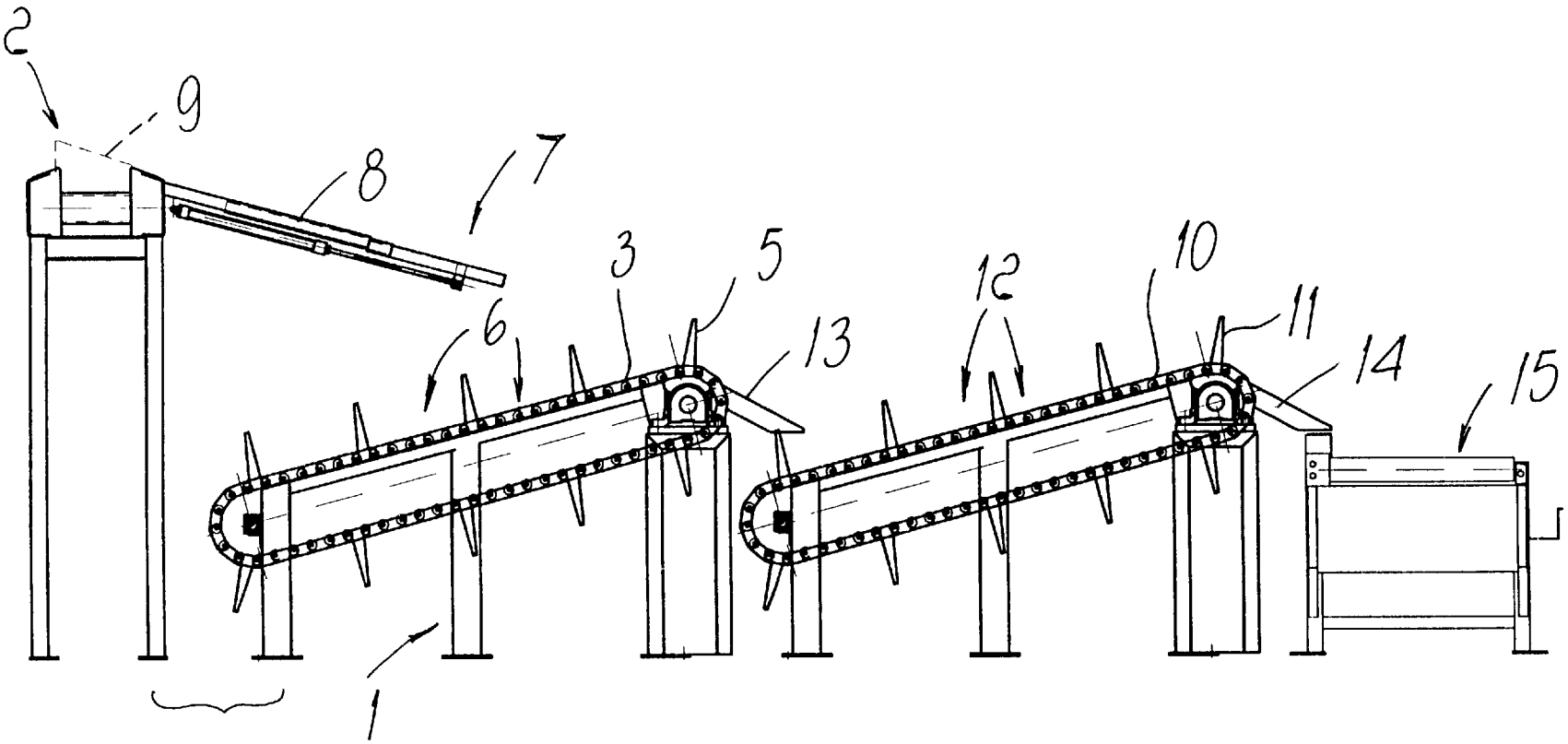
Figure 1C:
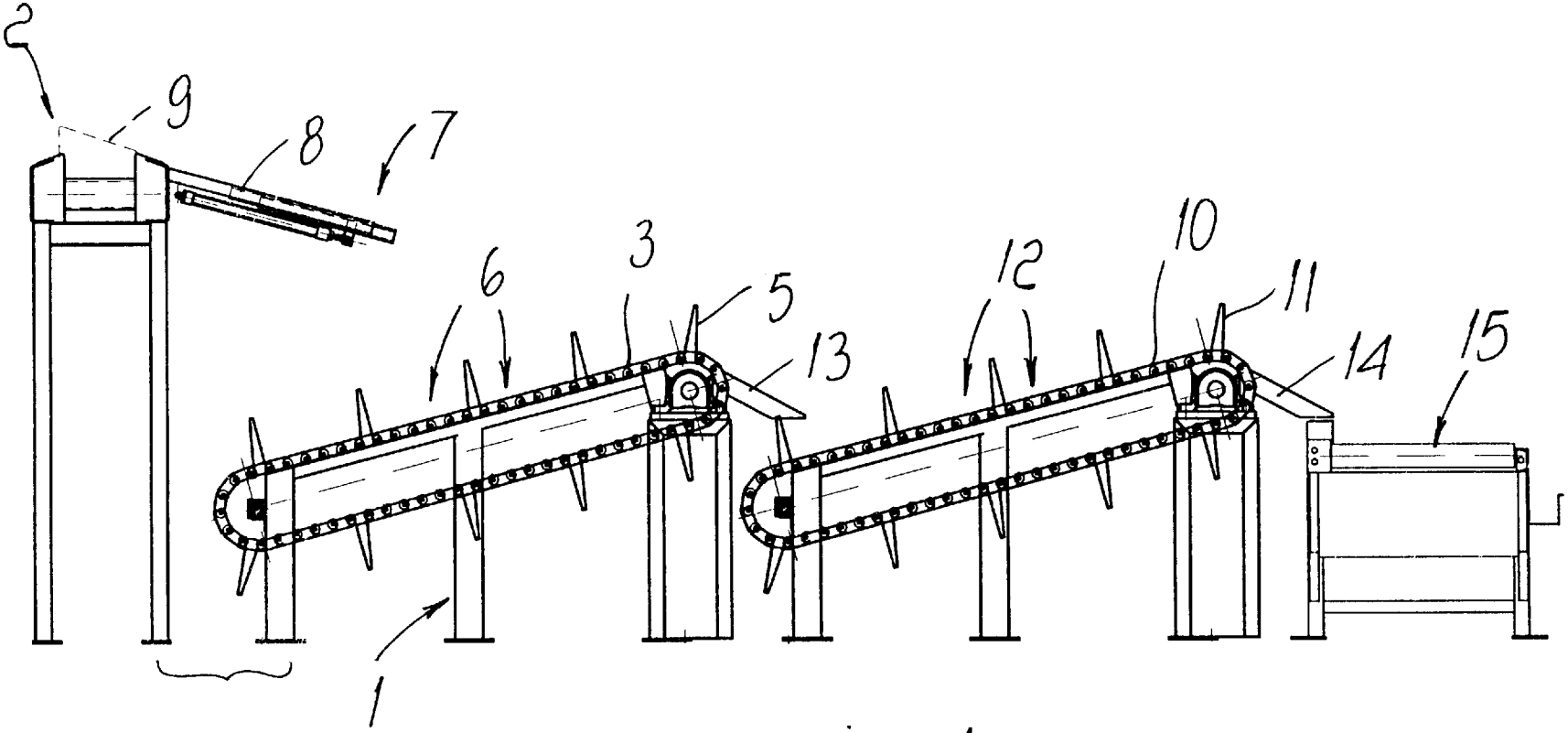

The cropped bars are conveyed selectively, depending on their dimensions, to the different storage compartments 6 formed on the chain units 3. For this purpose, the telescopic arms 8 are in fact elongated or shortened so that their end lies above the storage compartment 6 to be fed, as clearly shown in FIGS. 1*a*, 1*b* and 1*c*. The cropped bars thus fall into a different storage compartment 6 according to their dimensions.

At appropriate time intervals, i.e., after a preset quantity of bars has been accumulated in the storage compartments 6, the bars are selectively transferred to corresponding accumulation compartments 12 of the additional chain units 10, which in turn feed the bending bench 15.

For this purpose, advancement of the chain units 3 is of course actuated so as to cause the corresponding advancement of the compartments 6 towards the additional chain units 10.

After filling the accumulation compartments 12 of the additional chain units 10, the accumulated bars are likewise unloaded onto the bending bench 15.

Of course, the number of provided storage compartments 6 can be different from the one illustrated herein, according to the different operating requirements of the device.

In the illustrated embodiment, the storage device lies on a single side of the cropping line 2. However, the storage device may instead have a bilateral arrangement, so as to feed two different bar bending lines arranged symmetrically on either side of the cropping line.

FIGS. 2*a*, 2*b* and 2*c* illustrate a different embodiment of the storage device, wherein the conveyors are constituted by segmented folding arms 16. In this case, too, the extension of the inclined plane changes depending on the extended segments of the arms 16, so that it is possible to transfer the cropped bars, fed by the cropping line 2, to the various compartments 6 of the chain units 3, according to the different dimensions of the bars.

In the illustrated embodiment, moreover, the chain units 3 forming the storage compartments 6 feed the bending bench directly. This is possible, of course, even if the above-described telescopic arms 8 are used to convey the cropped bars.

Figure 3A:
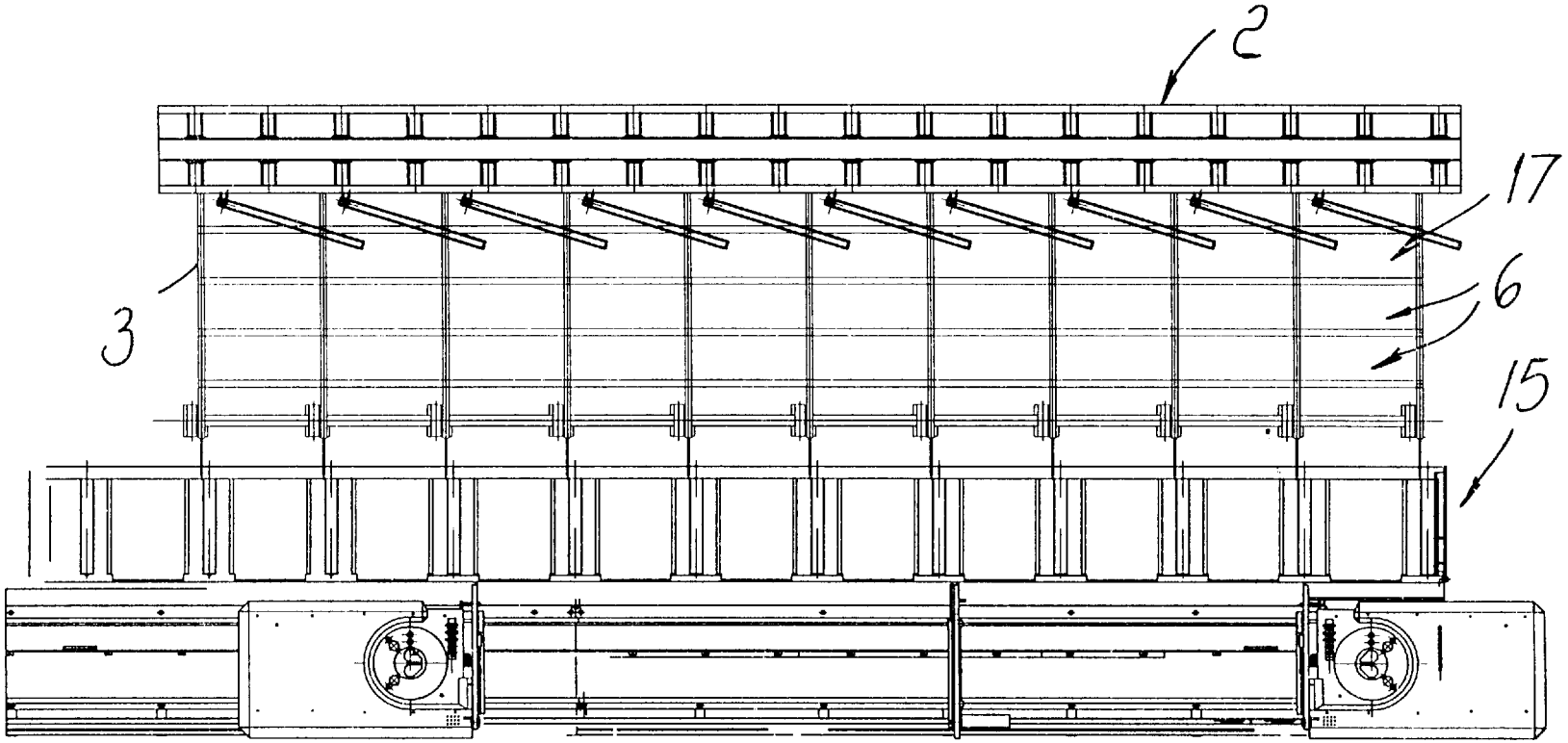
FIGS. 3*a*, 3*b* and 3*c* are respective plan views of a third embodiment of the storage device in the above different operating configurations.
Figure 3B:
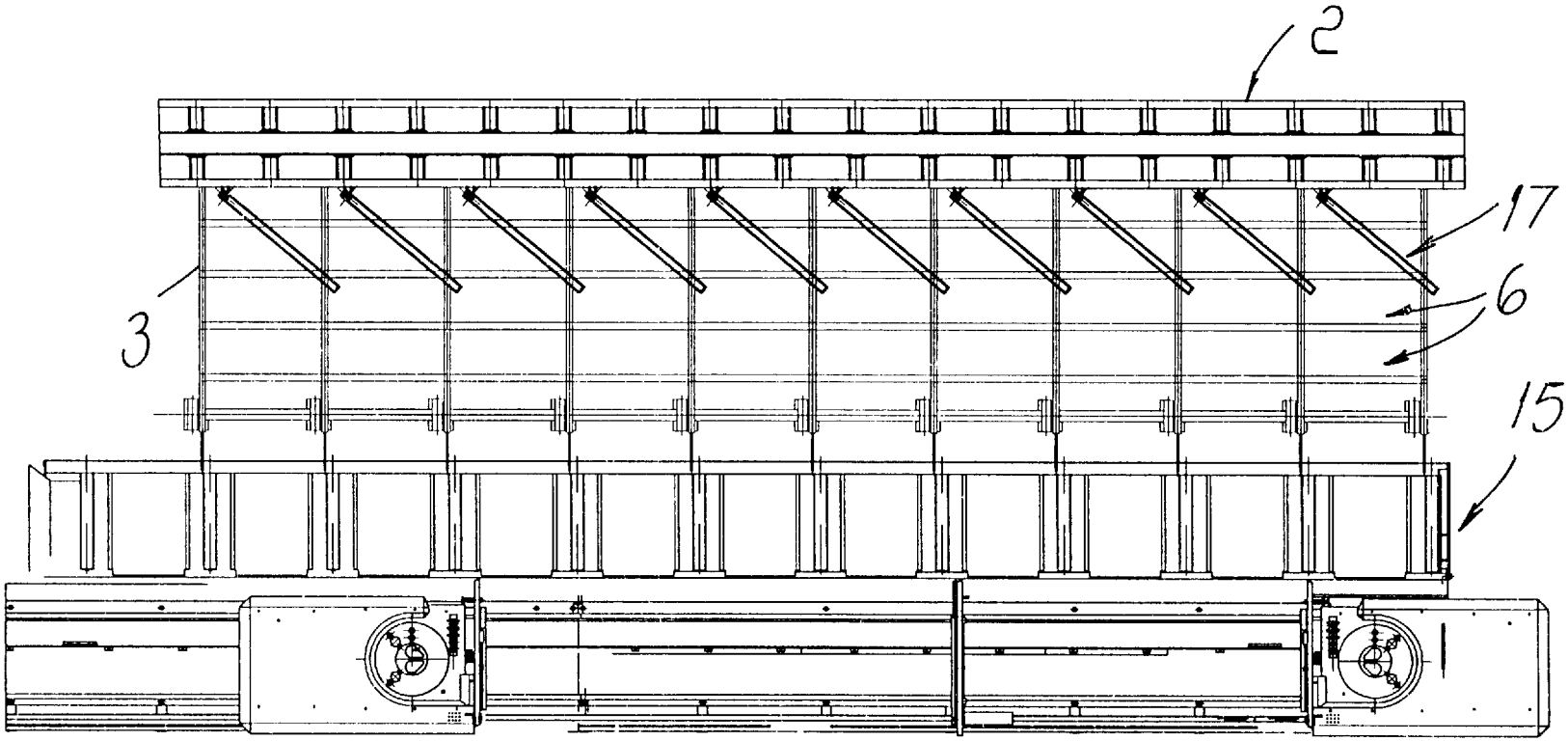
Figure 3C:
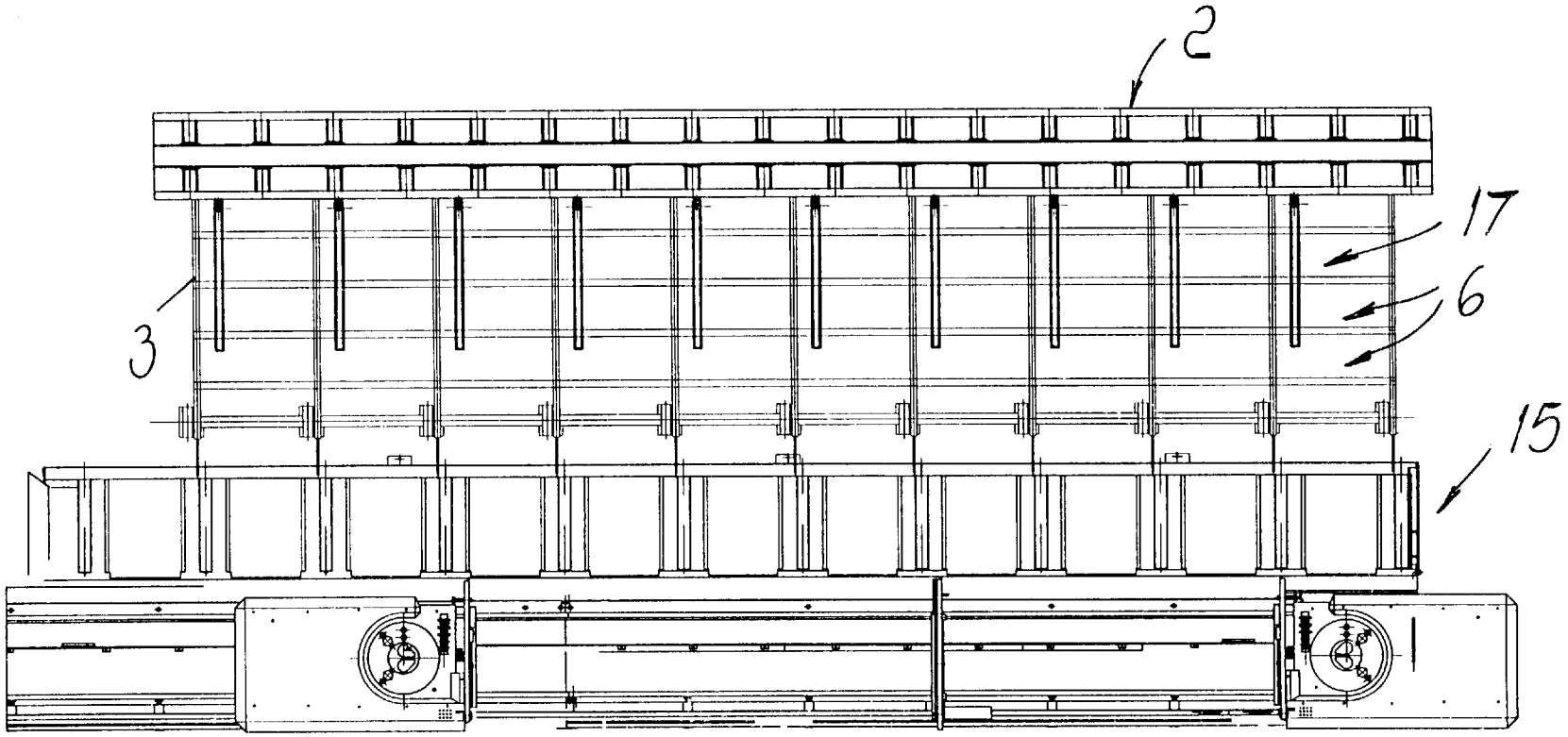

In the embodiment illustrated in FIGS. 3*a*, 3*b* and 3*c*, the cropped bar conveyors are constituted by arms 17 which have a constant length and can rotate simultaneously, under the actuation of motor elements which are not shown, about respective vertical pivoting axes arranged on the side which is adjacent to the cropping line 2. According to the angular position assumed by the arms 17, their projection transversely to the cropping line 2 varies so as convey the cropped bars, as in the previous cases, to the various storage compartments 6 formed on the underlying chain units 3.

Figure 4A:
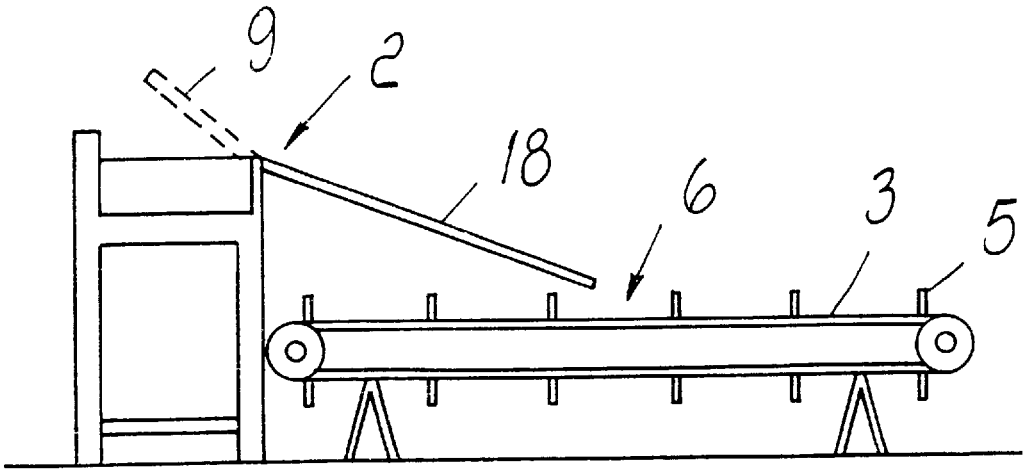
FIGS. 4*a*, 4*b* and 5 are elevational views of further embodiments of the storage device according to the present invention.
Figure 4B:
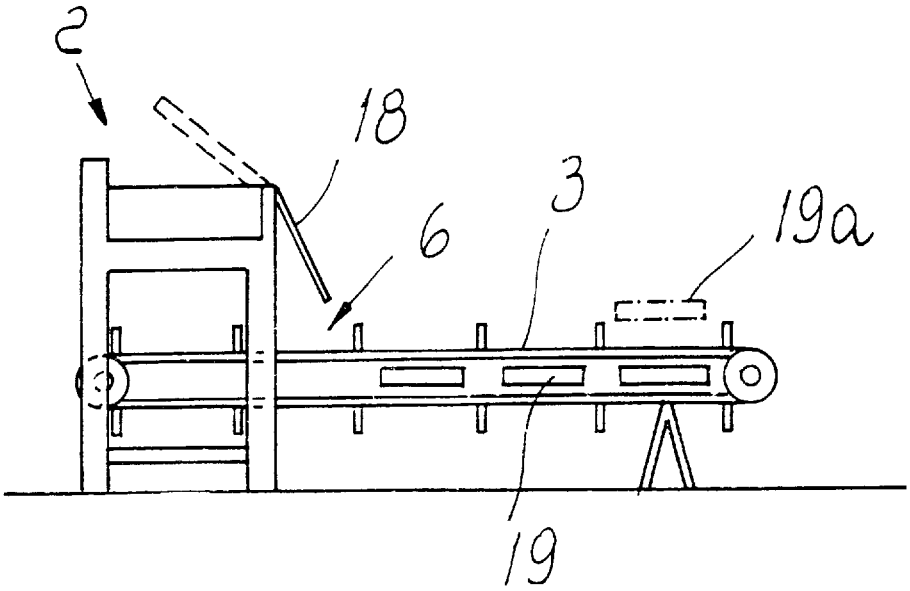

FIGS. 4*a* and 4*b* illustrate a further embodiment, wherein the cropped bar conveyors are constituted by fixed arms 18 arranged on vertical planes, lying transversely to the cropping line 2, and having an appropriate inclination.

In this embodiment, the chain units 3 can be actuated preferably in opposite advancement directions, under the control of reversible motor elements, so as to selectively place the storage compartments 6 at the exit region of the inclined plane formed by said arms 18.

In other words, the metal bars are sorted through the movement of the chain units 3, without altering the drop points of the bars, for example in a central region of the chain units.

In the embodiment illustrated in FIG. 4*a*, the chain units 3 are arranged on one side of the cropping line 2, whilst in the case of FIG. 4*b* the chain units 3 lie partially below the cropping line 2, so as to allow to use arms 18 having a limited extension and so that the exit region of the metal bars is located proximate to the cropping line 2.

Figure 5:
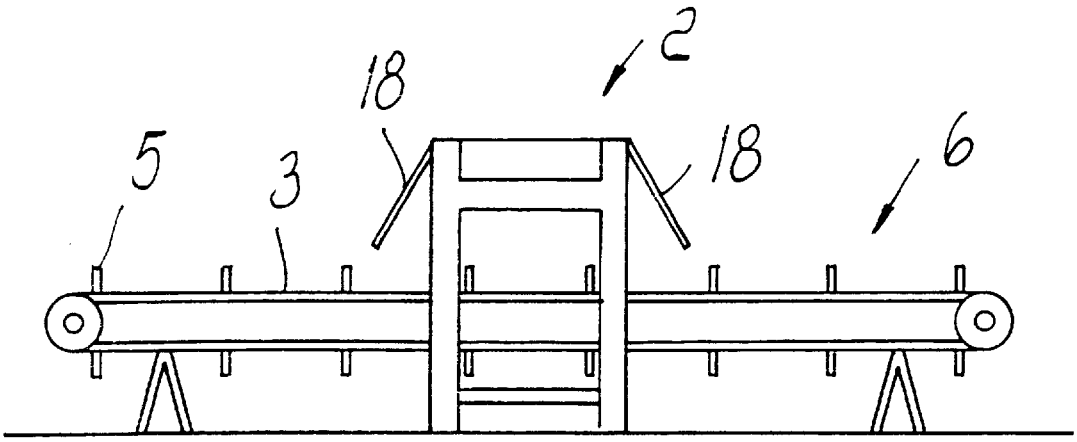

The embodiment illustrated in FIG. 5 provides for fixed arms 18 protruding bilaterally on vertical planes, arranged transversely to the cropping line 2, with an appropriate inclination. The chain units 3, which can be actuated preferably in opposite advancement directions, are arranged so as to pass below the cropping line 2.

It should be noted that it is possible to provide for the trapdoor-like opening of the cropping line 2, so as to allow the metal bars to fall directly onto the underlying storage compartment 6. In this way it is possible to provide three different methods for unloading the metal bars.

This embodiment, in addition to allowing to feed users arranged on either side of the cropping line, allows to significantly reduce the space requirements, since it is possible to use the space below the cropping line as well.

Figure 6:
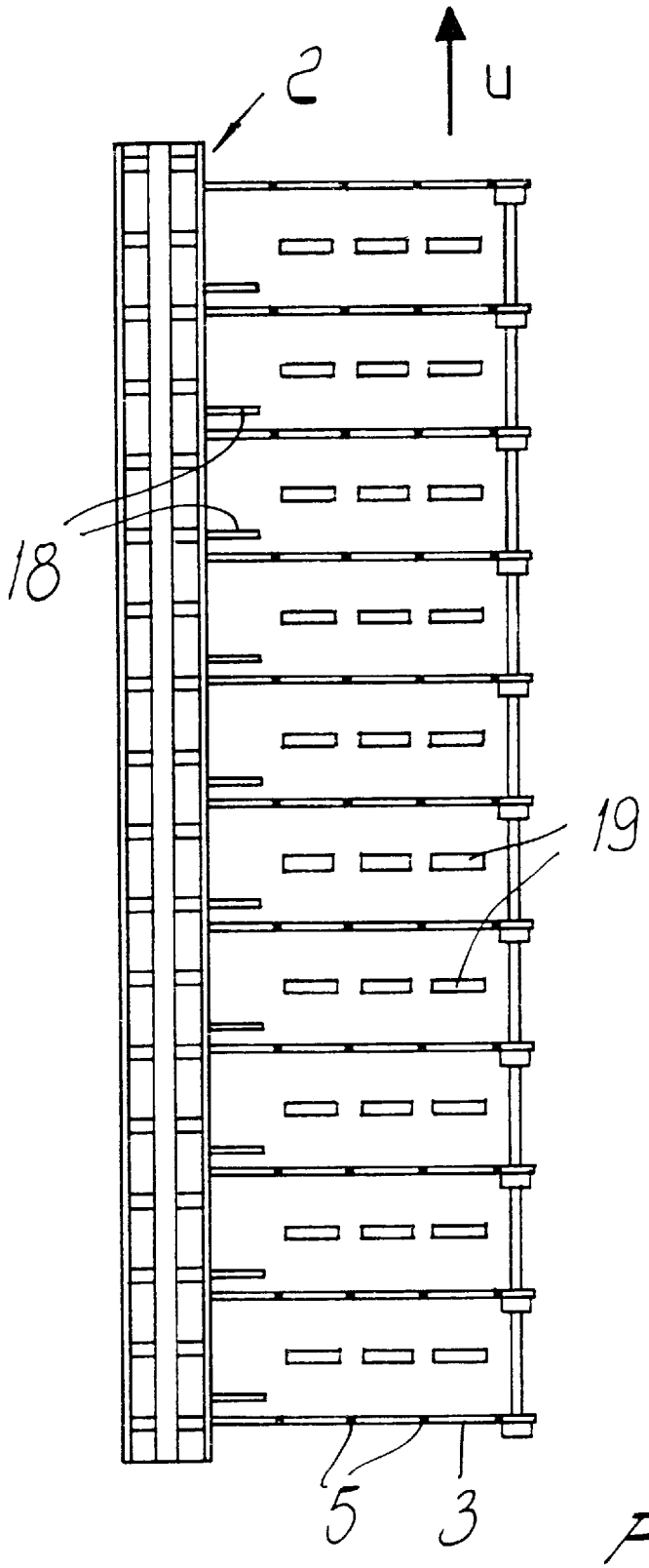
FIG. 6 is a plan view of the storage device of FIG. 4*b;*

In the embodiment shown in FIG. 6, the device allows to avoid the sequential unloading of the cropped metal bars from the storage compartments 6, i.e., the selective transfer of the bars to the corresponding accumulation compartments 12 of the additional chain units 10 or directly to the bending bench 15 according to the sequence determined by the succession of compartments 6.

For this purpose, the device has roller means 19 which are appropriately motorized and are arranged below the chain units 3, in a direction parallel to the cropping line 2, and can be raised above chain units 3 to take the metal bars to be unloaded, as shown by the dashed line 19*a* in FIG. 4*b*. In the illustrated embodiment, the roller means 19 are constituted by three roller conveyors arranged side-by-side transversely to the chain units 3; however, it is possible to use a single roller conveyor.

According to this embodiment, after the preset quantity of bars has been accumulated in the storage compartments 6, compartments 6 are moved above the preset roller conveyor 19 and then the roller conveyor 19 is lifted into the position 19*a* to take the bars. The bars are transferred in a longitudinal direction by the roller conveyor 19, which is appropriately motorized, as shown by the arrow U in FIG. 6, so as to feed a following exit line.

Figure 8:
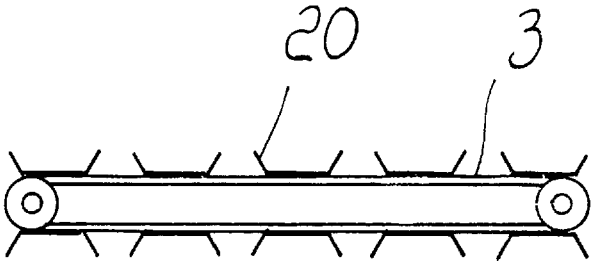
FIGS. 7*a*, 7*b* and 8 are corresponding plan views and elevational views of still another embodiment of the storage device according to the present invention.
Figure 7A:
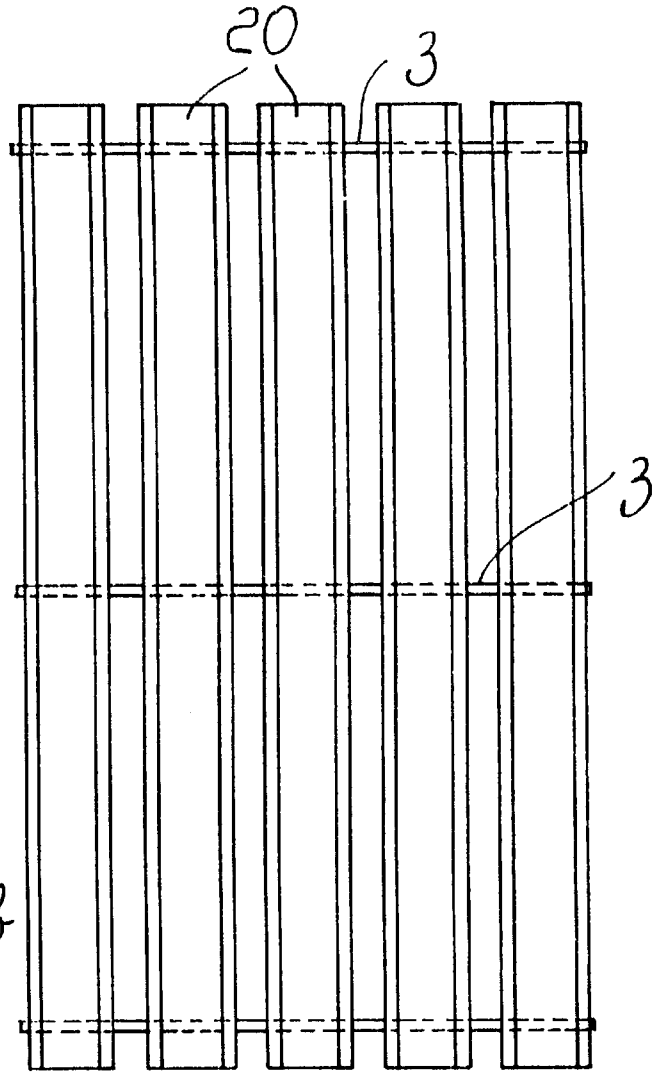
Figure 7B:
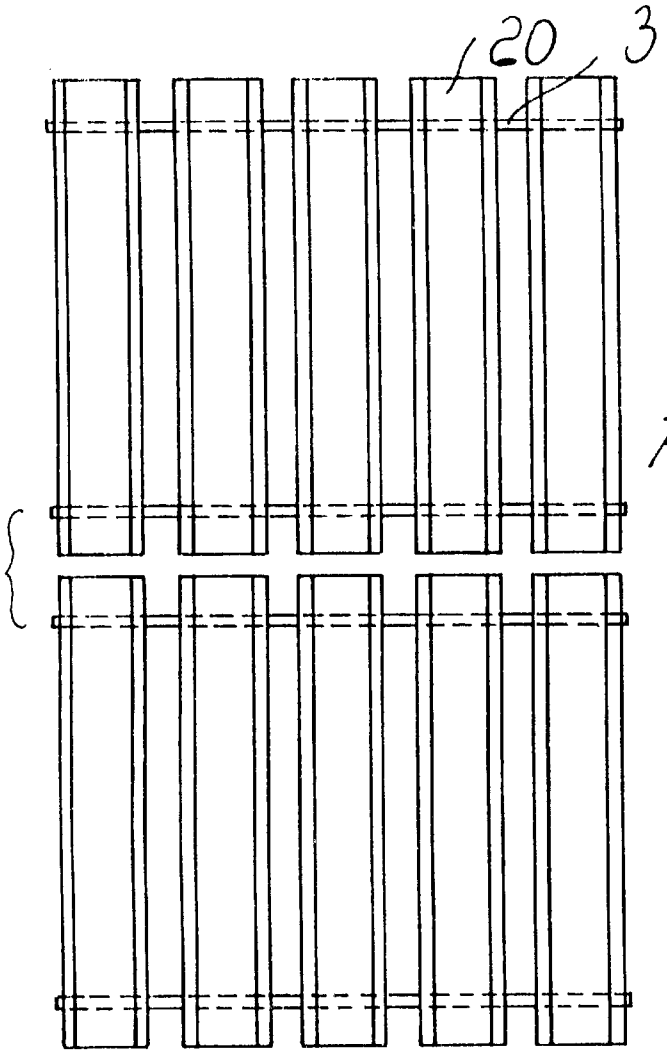

FIGS. 7*a*, 7*b* and 8 illustrate another embodiment of the device, wherein the cropped metal bar storage compartments 6 are formed by a plurality of U-shaped elements 20, supported by the chain units 3 and arranged parallel to each other and side-by-side longitudinally to the cropping line 2, each U-shaped element 20 forming a cavity for receiving the metal bars.

This embodiment allows to store metal bars of any size, particularly even bars having a limited length, keeping the chain units 3 appropriately spaced. More particularly, it is possible to use U-shaped elements 20 which are as long as the storage device and are supported by an adapted number of spaced chains 3 (FIG. 7*a*) or, as an alternative, to use shorter U-shaped elements arranged in series and supported by respective pairs of chain units 3 (FIG. 7*b*). From the above description, it is readily apparent that the selective elongation or shortening of the telescopic arms 8, the variation of the extension of the folding arms 16, the variation of the projection of the rotatable arms 17, or the actuation in opposite advancement directions of the chain units 3, makes possible to selectively reach, during accumulation of cropped metal bars, any of the storage compartments 6, regardless of their succession, to enable delivery of bars of a certain size into a compartment already containing bars of the sizes necessary to constitute a same batch. Indeed, the arms 8, 16, 17 and motor elements 4 of the reversible type constitute positioning means for positioning the bar delivery end of the conveyors 7 in delivery relation with selected ones of the plurality of storage compartments 6, regardless of the sequence determined by their succession.

In summary, the chain storage device allows to automatically feed the bending bench with the metal bars taken from the cropping line without resorting to cranes or movable trucks. The device according to the present invention is compact and ensures correct optimization of the bar cropping.

The chain storage device is also provided in a constructively simple manner, so as to achieve a proportional reduction in production and running costs.

In the practical embodiment of the invention, the materials employed, as well as the shape and the dimensions, may be any according to requirements.

What is claimed is:

1. A storage device for metal bar cropping lines, comprising:

a plurality of storage compartments being parallel to each other and arranged side-by-side, in succession, for storing cropped metal bars of different sizes, said storage compartments being arranged longitudinally with respect to a cropping line to receive a preset quantity of cropped metal bars of different sizes;

conveyor means for conveying said cropped metal bars, fed by said cropping line, to a bar delivery end thereof for further selective delivery to different storage compartments in accordance with the bar size necessary to constitute a batch;

flexible means for shifting said storage compartments transversely to said cropping line to positions for receiving said cropped metal bars and, upon accumulation of the preset quantity of metal bars in said storage compartments, to a position for unloading said cropped metal bars; and positioning means for positioning the bar delivery end of said conveyor means, during accumulation of the metal bars, in a delivery relation with a selected one of said storage compartments for delivery of metal bars therein, the selected storage compartment being any of said plurality of storage compartments and being selectable regardless of the succession of said compartments.

2. The device of claim 1, wherein said flexible means support a plurality of partitions for forming said storage compartments.

3. The device of claim 1, wherein said conveyor means have a plurality of variable-length arms protruding laterally from the top of said cropping line, inclined downwards on vertical planes, and lying transversely to said cropping line, said variable-length arms constituting said bar delivery end positioning means.

4. The device of claim 1, wherein said conveyor means comprise a plurality of segmented folding arms protruding laterally from the top of said cropping line and inclined downwards along vertical planes which lie transversely to said cropping line, said folding arms constituting said bar delivery end positioning means.

5. The device of claim 1, wherein said conveyor means comprise a plurality of rotatable arms which are rotatable about respective vertical pivoting axes, protrude laterally from the top of said cropping line and are inclined downwards along vertical planes the angle whereof being variable with respect to said cropping line, said rotatable arms constituting said bar delivery end positioning means.

6. The device of claim 1, wherein said positioning means are constituted by reversible motor means for actuating said flexible means in opposite advancement directions, so as to selectively place any of said plurality of storage compartments at the bar delivery end of said conveyor means, said conveyor means comprising a plurality of fixed arms protruding laterally from the top of said cropping line, said fixed arms being inclined downwards along vertical planes which lie transversely to said cropping line.

7. The device of claim 6, wherein said fixed arms protrude bilaterally from said cropping line, so as to feed said metal bars to corresponding storage compartments supported by said flexible means which pass below said cropping line.

8. The device of claim 7, wherein said cropping line is openable in a trapdoor-like fashion, so as to allow said metal bars to fall directly onto an underlying storage compartment.

9. The device according to claim 1, wherein said cropping line has overturning extractors for transferring said cropped metal bars to said conveyor means.

10. The device of claim 1, wherein said flexible means are adapted to cooperate with additional flexible means likewise arranged on vertical planes which lie transversely to said cropping line and are adapted to form respective accumulation compartments for said cropped metal bars, said accumulation compartments being arranged parallel to each other and side-by-side longitudinally to said cropping line.

11. The device of claim 1, wherein said plurality of storage compartments is formed by a plurality of U-shaped elements supported by said flexible means, said U-shaped elements being arranged parallel to each other and side-by-side longitudinally to said cropping line so as to form respective cavity compartments for receiving said metal bars.

12. The device of claim 1, further comprising motorized roller means arranged below said flexible means, in a direction which is parallel to said cropping line, for selective transfer and unloading of the metal bars accumulated in the storage compartments, said roller means being raisable above said flexible means to take the metal bars from the storage compartments selected for unloading.

13. A storage device for metal bar cropping lines, comprising:

a plurality of storage compartments being parallel to each other and arranged side-by-side, in succession, for storing cropped metal bars of different sizes, said storage compartments being arranged longitudinally with respect to a cropping line to receive a preset quantity of cropped metal bars of different sizes;

conveyor means for conveying said cropped metal bars, fed by said cropping line, to a bar delivery end thereof for further selective delivery to different storage compartments in accordance with the bar sizes necessary to constitute a batch;

flexible means for shifting said storage compartments transversely to said cropping line to positions for receiving said cropped metal bars and, upon accumulation of the preset quantity of metal bars in said storage compartments, to a position for unloading said cropped metal bars; and a plurality of arms provided at said conveyor means so as to define at a free end thereof said bar delivery end, said arms being operatable to position said bar delivery end, during accumulation of the metal bars, in a delivery relation with a selected one of said storage compartments for delivery of metal bars therein, the selected storage compartment being any of said plurality of storage compartments and being selectable regardless of the succession of said compartments.

14. The device of claim 13, wherein said plurality of arms have variable length, protrude laterally from the top of said cropping line, are inclined downwards on vertical planes, and lie transversely to said cropping line.

15. The device of claim 13, wherein said plurality of arms are constituted by segmented folding arms with extendable length, protruding laterally from the top of said cropping line and being inclined downwards along vertical planes which lie transversely to said cropping line.

16. The device of claim 13, wherein said plurality of arms protrude laterally from the top of said cropping line, are inclined downwards along vertical planes the angle whereof being variable with respect to said cropping line, and are rotatable about respective vertical pivoting axes thereof so as to project transversely to the cropping line at variable distances.

17. The device of claim 13, wherein said plurality of arms is constituted by fixed arms protruding laterally from the top of said cropping line, said fixed arms being inclined downwards along vertical planes which lie transversely to said cropping line, and said flexible means being actuatable in opposite advancement directions, so as to selectively place any of said plurality of storage compartments at said bar delivery end defined at the free end of said fixed arms.

18. The device of claim 17, wherein said cropping line is openable in a trapdoor-like fashion, so as to allow said metal bars to fall directly onto an underlying storage compartment.

19. The device of claim 13, wherein said flexible means are adapted to cooperate with additional flexible means likewise arranged on vertical planes which lie transversely to said cropping line and are adapted to form respective accumulation compartments for said cropped metal bars, said accumulation compartments being arranged parallel to each other and side-by-side longitudinally to said cropping line.

20. A storage device for metal bar cropping lines, comprising:

a plurality of storage compartments being parallel to each other and arranged side-by-side, in succession, for storing cropped metal bars of different sizes, said storage compartments being arranged longitudinally with respect to a cropping line to receive a preset quantity of cropped metal bars of different sizes;

conveyor means for conveying said cropped metal bars, fed by said cropping line, to a bar delivery end thereof for further selective delivery to different storage compartments in accordance with the bar sizes necessary to constitute a batch;

flexible means for shifting said storage compartments transversely to said cropping line to positions for receiving said cropped metal bars and, upon accumulation of the preset quantity of metal bars in said storage compartments, to a position for unloading said cropped metal bars;

positioning means for positioning the bar delivery end of said conveyor means, during accumulation of the metal bars, in a delivery relation with a selected one of said storage compartments for delivery of metal bars therein, the selected storage compartment being any of said plurality of storage compartments and being selectable regardless of the succession of said compartments; and motorized roller means arranged below said flexible means, in a direction which is parallel to said cropping line, for selective transfer and unloading of the metal bars accumulated in the storage compartments, said roller means being raisable above said flexible means to take the metal bars from the storage compartments selected for unloading.

* * * * *